US005375929A

United States Patent [19]

Bergmoser

[11] Patent Number: 5,375,929

[45] Date of Patent: Dec. 27, 1994

[54] ARTICLE FOR STORING FRUITS, VEGETABLES AND SIMILAR ITEMS

[76] Inventor: Sally E. Bergmoser, 3710 Foxmoor Cir., Alpharetta, Ga. 30202

[21] Appl. No.: 959,447

[22] Filed: Oct. 13, 1992

[51] Int. Cl.[5] ..... B65D 30/06; B65D 30/22; B65D 33/16; B65D 85/34

[52] U.S. Cl. ..... 383/38; 383/22; 383/66; 383/117; 426/106; 426/112; 426/119; 426/415; 426/419

[58] Field of Search ..... 426/108, 110, 119, 120, 426/106, 419; 383/103, 117, 22, 38, 43, 66, 71

[56] References Cited

U.S. PATENT DOCUMENTS

| | | | |
|---|---|---|---|
| 179,236 | 6/1876 | Walsh | 383/71 |
| 203,678 | 5/1878 | Vogel . | |
| 1,204,068 | 11/1916 | Robin et al. | 383/71 |
| 1,611,119 | 12/1926 | Lipper . | |
| 1,758,347 | 5/1930 | Beibin . | |
| 1,872,640 | 8/1932 | Pink . | |
| 1,942,086 | 1/1934 | Cheatham . | |
| 2,631,629 | 3/1953 | Lee | 383/43 |
| 3,036,616 | 5/1962 | Allen | 383/38 |
| 4,223,043 | 9/1980 | Johnson . | |
| 4,247,005 | 1/1981 | Buxton . | |
| 4,388,739 | 6/1983 | Martinon et al. | 383/38 |

FOREIGN PATENT DOCUMENTS

| | | |
|---|---|---|
| 2602400 | 8/1986 | France . |
| 2230693 | 10/1990 | United Kingdom . |

OTHER PUBLICATIONS

Reader's Digest Practical Problem Solver, p. 317, 1991.

*Primary Examiner*—Michael W. Ball
*Assistant Examiner*—Richard Crispino
*Attorney, Agent, or Firm*—Michael Drew

[57] ABSTRACT

An article for storing fruits and vegetables (10) is formed from a sheet of mesh material (20) which has two edges (22) placed next to one another to form a tubular bag. The ends of elastic strips (24) parallely affixed along the length of the sheet (20) are joined to form rings creating pockets (26) in the bag.

2 Claims, 2 Drawing Sheets

ARTICLE FOR STORING FRUITS, VEGETABLES AND SIMILAR ITEMS

TECHNICAL FIELD OF THE INVENTION

The present invention relates to articles for storing fruits and vegetables, and more particularly, to an article for storing fruits, vegetables and similar items segregated from one another.

BACKGROUND OF THE INVENTION

Many fruits and vegetables are stored in clusters in bowls, bins or baskets prior to consumption by a consumer. Problems arise in storing fruits and vegetables in this manner because the items touch one another, air is not allowed to freely circulate around the items, and all of the items do not have equal, free access to sunlight. Some fruits and vegetables which are subject to problems due to cluster storage include apples, oranges, peaches, pears, tomatoes, onions, potatoes, and bell peppers. One problem is that many fruits and vegetables which touch one another often rot at the point where contact is made between items. Some fruits and vegetables will also rot at the point of contact with the bowl, bin, basket or other container. Another problem is that many fruits and vegetables need exposure to sunlight to ripen while being stored. Fruits and vegetables which are intended to ripen by exposure to sunlight will ripen better if all items have equal access to sunlight. Each stored item will also ripen more evenly if none of its surfaces are shadowed by another item. An additional problem in cluster storage is that gases are often emitted from ripening fruits and vegetables. When fruits and vegetables are stored in extremely close proximity, and especially when touching one another, gases from one fruit may permeate another fruit affecting the ripening rate for the second fruit and also affecting taste of the second fruit due to the absorption of gases from the first fruit. Another problem in cluster storage is that touching, restricted air circulation, and restricted sunlight often promote infestation of the fruits and vegetables by bugs or the growth of mold or mildew. Still another problem of cluster storage is that it is more difficult to control the environmental temperature for fruits that are very sensitive to temperature fluctuations.

Many of the problems associated with cluster storage of fruits and vegetables also occur in the cluster storage of plant bulbs and similar articles. In particular, it is often necessary to store plant bulbs in a cool environment away from sunlight without one bulb touching another bulb. Thus, it can be appreciated that it would be desirable to have a means for storing fruits, vegetables and similar articles without touching one another, without touching similar or like articles, without touching a container which promotes rotting, without limiting the circulation of air around the item, and without limiting access of the item to sunlight.

SUMMARY OF THE INVENTION

It is an object of the invention to provide a means for storing fruits, vegetables and similar items without touching one another.

It is a further object of the invention to provide a means for storing fruits, vegetables and similar items without touching a container which promotes rotting.

It is also an object of the invention to provide the above means for storage while also allowing air to circulate around the stored items and allowing maximum exposure to sunlight.

It is an additional object of the invention to provide means for storage of different sizes and configurations of fruits, vegetables and similar items.

It is an even further object of the invention to provide the aforementioned means for storage which also promotes ripening of the items stored.

In a preferred embodiment of the invention, an article for segregating and storing fruits, vegetables and similar items is formed from a sheet of mesh material having two edges placed next to one another to form a tubular bag. Elastic strips are parallely affixed along the length of the sheet and are joined to form rings which create pockets in the resulting tubular bag. The edges of the sheet are parallel and adjacent to one another when the tube is formed and serve as openings providing access to the pockets formed by the elastic rings.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 1:
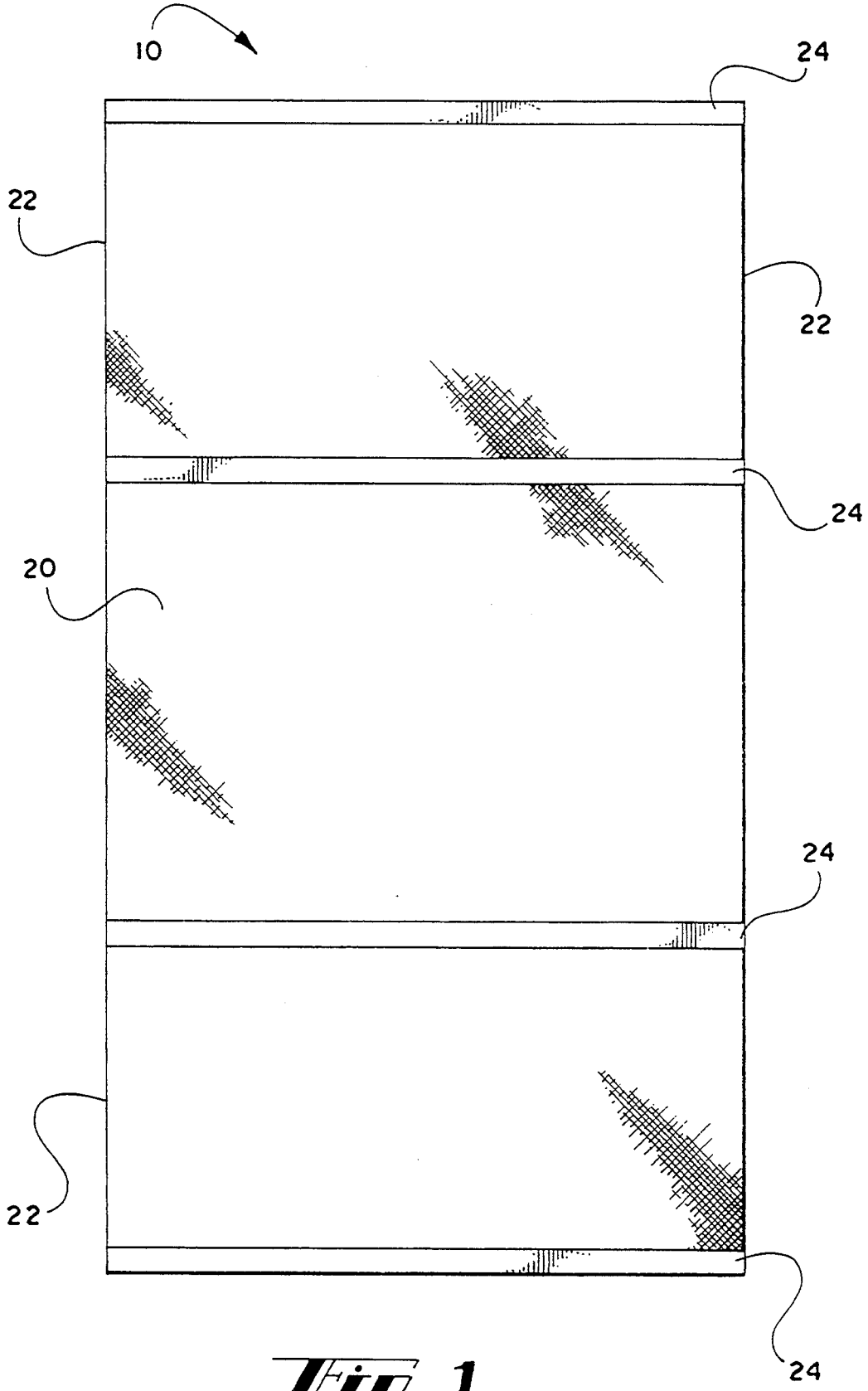
FIG. 1 is an illustration of a sheet used to form an article for storing fruits, vegetables and similar items according to a preferred embodiment of the invention.

While the specification concludes with claims particularly pointing out and distinctly claiming the subject matter which is regarded as the present invention, the invention will now be described with reference to the following description of embodiment taken in conjunction with the accompanying drawings. Throughout the drawings, a single reference numeral is used to refer to like features.

In order to distinctively store fruits, vegetables and similar items, the present invention uses essentially a mesh tube which is separated into individual pockets along its length. Referring first to FIG. 1, therein is shown the basic components of an article for storing fruits, vegetables and similar items 10 according to a preferred embodiment of the invention. A simple method for forming the storage article 10 is to form a sheet of mesh material 20 into a tubular configuration. The mesh sheet 20 is generally formed into a tube, or bag, by bringing together longitudinally-oriented edges 22 of the mesh sheet 20. To form storage pockets in the formed tube, strips of elastic material 24 are spaced along the length of the mesh material 20, extending between the longitudinally-oriented parallel edges 22 of mesh material 20.

Figure 2:
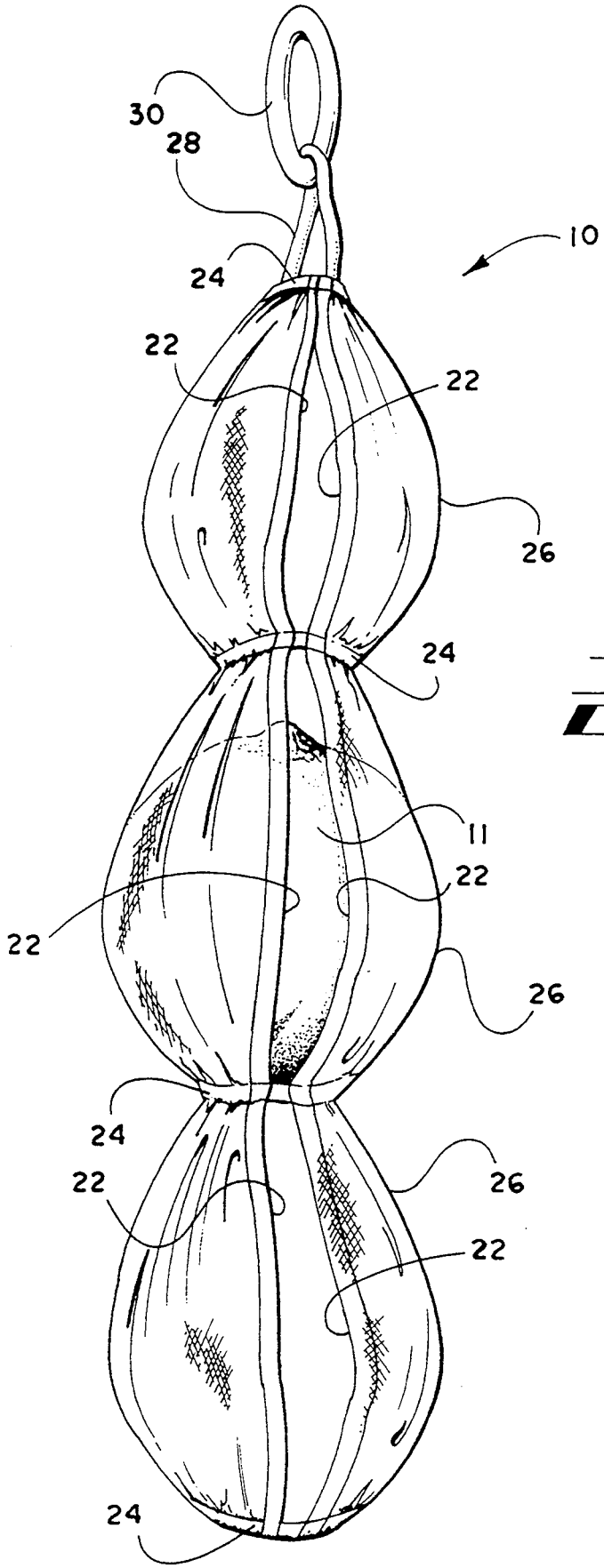
FIG. 2 is an illustration of the article of FIG. 1 in its tubular configuration.

Referring now also to FIG. 2, therein can be seen the storage article 10 in its tubular configuration and holding an onion 11. FIG. 2 shows a sheet of mesh material 20 which has two longitudinally-oriented parallel edges 22 aligned in close proximity to create a tube. The parallel edges 22 are brought together and pockets 26 of the tube are formed when the ends of the elastic bands 24 which terminate at the edges 22 are joined. FIG. 1 essentially shows the elastic bands 24 stretched to illustrate the mesh sheet 20 in its unaltered configuration. When the elastic bands 24 are allowed to contract and their ends brought together the pockets 26 are formed.

The unjoined edges 22 of the sheet 20 provide openings for the pockets 26. A cord 28 is attached to the top end of the now tube-like article 10 in order to suspend the storage article 10 and its contents. A ring 30 may also be added, attached to the cord 28, to provide a convenient means for supporting the article 10.

The mesh material 20 allows air to freely circulate around any item, such as an onion 11, that is placed in one of the pockets 26. The mesh material may be nylon or polyester, or a blended material that is lightweight and permits air circulation. Nylon and polyester also offer the advantage of being washable and durable. As an alternate method of bunching or crimping the tubular configuration of the mesh 20, elastic bands may be spaced along the mesh sheet 20 as its parallel edges 22 are held in proximity to one another. Although the preferred embodiment discussed herein utilizes elastic strips 24 or bands to create pockets 26, nonelastic segregating means could also be used. However, the benefit gained from using the elastic strips or bands is that the opening into each pocket 26 as defined by the edges of the mesh material 20 and accommodate a variety of sizes of items to be inserted into the pockets. The edges 22 of the mesh material 20, which extend between each elastic separation 24, stretch the elastic as the edges 22 are pulled apart. Because of the flexibility of each opening, a pocket may accommodate an item as small as a tulip bulb but as large as a jumbo onion. The article 10 can accommodate rigid, hearty items such as apples but also easily accommodate delicate items such as tomatoes. A delicate item such as a tomato can be inserted by pulling apart the edges 22 and inserting the delicate fruit. Also, because the elastic 24 permits expansion of the opening for the pocket, an item of fruit such as a pear or tomato which has ripened during storage can be easily removed without damage thereto.

The mesh material 20 of the object also allows items placed in the pockets 20 to be exposed to sunlight if the article 10 is hung in a sunny location. The inserted items' exposure to sunlight is unobstructed by the lightweight material of the mesh 20. The elastic strips 24 or other means used to crimp the tube keep stored items segregated from one another. Stored items do not touch one another. Gases or undesirable moisture are allowed to escape through the permeable surface of the mesh 20. The article 10 eliminates problems associated with cluster storage of fruits, vegetables and similar items.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. An article for storing fruits and vegetables comprising a tube of mesh material adapted for permitting passage of gases from fruits and vegetables, air and sunlight having a plurality of elastic constricting means spaced along and affixed to a length of said tube of mesh material, said tube of mesh material having openings extending lengthwise between said constricting means whereby pockets are defined in said tube by said constricting means and said openings.

2. An article for storing fruits and vegetables comprising:

a sheet of mesh material adapted for permitting passage of gases from fruits and vegetables, air and sunlight having at least a pair of longitudinally aligned parallel edges;

a plurality of elastic strips spaced along and affixed to said sheet of mesh material, each said elastic strip perpendicular to said parallel edges of said sheet of mesh material and traversing said sheet of mesh material; and means joining ends of said elastic strips to form a tube and to define pockets each having a lengthwise opening defined by said parallel edges.

* * * * *